US007862037B2

(12) United States Patent
Kunioka

(10) Patent No.: US 7,862,037 B2
(45) Date of Patent: Jan. 4, 2011

(54) SHEET FEED CASSETTE AND IMAGE FORMING APPARATUS

(75) Inventor: Satoshi Kunioka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 328 days.

(21) Appl. No.: 12/183,606

(22) Filed: Jul. 31, 2008

(65) Prior Publication Data

US 2009/0041525 A1 Feb. 12, 2009

(30) Foreign Application Priority Data

Aug. 9, 2007 (JP) ..... 2007-207469

(51) Int. Cl.
*B65H 1/00* (2006.01)

(52) U.S. Cl. ..... 271/171

(58) Field of Classification Search ..... 271/171, 271/164; 206/387.14
See application file for complete search history.

(56) References Cited

U.S. PATENT DOCUMENTS 5,895,041 A * 4/1999 Nishimura ..... 271/171

FOREIGN PATENT DOCUMENTS

JP 05188715 A * 7/1993
JP 6-144641 5/1994
JP 2002-351263 12/2002
JP 2004-331253 11/2004
JP 2004331253 A * 11/2004
JP 2005-225647 8/2005

* cited by examiner

*Primary Examiner*—Stefanos Karmis
*Assistant Examiner*—Gerald W McClain
(74) *Attorney, Agent, or Firm*—Cooper & Dunham LLP

(57) ABSTRACT

An image forming apparatus has a sheet feed cassette to store a sheet supplied to the image forming apparatus. The sheet feed cassette has a cassette body and a cassette cover. The cassette body stores the sheet and has first and second cassette portions coupled adjustably in length. The cassette cover is detachably mounted on the cassette body to cover its upper portion and has first and second cover portions coupled adjustably in length. The cassette cover has a fitting portion, and the cassette body has fitting receive portions in the first and second cassette portions. Each of the fitting receive portions is fittable with the fitting portion. The fitting receive portions overlap in a sheet feed direction when the cassette body is retracted. Of the fitting receive portions, one fitting receive portion not fitted with the fitting portion when the cassette body is extended is at least partially closed.

3 Claims, 6 Drawing Sheets

SHEET FEED CASSETTE AND IMAGE FORMING APPARATUS

CROSS-REFERENCE TO RELATED APPLICATIONS

The present patent application claims priority pursuant to 35 U.S.C. §119 from Japanese Patent Application No. 2007-207469, filed on Aug. 9, 2007 in the Japan Patent Office, the entire contents of which are hereby incorporated herein by reference.

BACKGROUND OF THE INVENTION

1. Field of the Invention

The present invention relates to a sheet feed cassette and an image forming apparatus with the sheet feed cassette, and more specifically, to a sheet-feed cassette adjustable in length and having a cassette body for storing a recording medium and a cassette cover for covering the cassette body, and an image forming apparatus with the sheet feed cassette.

2. Description of the Background

Image forming apparatuses are used as copiers, facsimile machines, printers, and multi-functional devices combining several of the foregoing capabilities. One conventional type of image forming apparatus has a recording head configured as, for example, a liquid discharge head for discharging liquid droplets of a recording liquid such as ink. Such image forming apparatus discharges liquid droplets of a recording liquid from nozzles of the liquid discharge head to form a desired image on a recording medium, for example, a paper sheet.

Such image forming apparatus may have a sheet feed cassette detachably mounted in the image forming apparatus (also referred to as a "sheet feed tray" or "sheet feeding device").

Such sheet feed cassette typically has a cassette body or sheet feed tray to store sheets and a cassette cover to cover an upper portion of the cassette body. In such case, the cassette cover may also serve as a sheet output tray to which the sheet is output after image formation.

One conventional type of sheet feed cassette has a so-called expandable structure, in which the length of both the cassette body and cassette cover is adjustable so as to store a variety of sheets of different sizes.

For such expandable type of sheet feed cassette, when the cassette body is retracted and the cassette cover is extended, such expandable type of sheet feed cassette may be mounted in an image forming apparatus. In such case, even though such sheet feed cassette may appear to be correctly mounted in the image forming apparatus, in actuality a sheet feed error may be caused by improper setting of the sheet feed cassette. Consequently, an operator may need to remount the cassette body and the cassette cover in the image forming apparatus.

In such case, a sensor might be provided in such image forming apparatus to detect whether or not the cassette body and the cassette cover are correctly mounted. If the cassette body and the cassette cover are not mounted at their correct positions, such image forming apparatus might stop a sheet feed operation and notify an operator of the improper mounting. However, even with such a configuration, the operator must still remount the cassette body and the cassette cover in the image forming apparatus.

Consequently, there is a need for an image forming apparatus with a sheet feed cassette capable of preventing a cassette body and/or a cassette cover from being improperly mounted in the first place, thus preventing occurrence of a sheet feed error.

SUMMARY OF THE INVENTION

Example embodiments of the present invention provide an image forming apparatus with a sheet feed cassette capable of preventing a cassette body and/or a cassette cover from being improperly mounted and thus preventing occurrence of a sheet feed error.

In one example embodiment of the present invention, an image forming apparatus has a sheet feed cassette to store a sheet supplied to the image forming apparatus. The sheet feed cassette has a cassette body and a cassette cover. The cassette body stores the sheet supplied to the image forming apparatus and has a first cassette portion and a second cassette portion that are coupled adjustably in length. The cassette cover is detachably mounted on the cassette body to cover an upper portion of the cassette body and has a first cover portion and a second cover portion that are coupled adjustably in length. The cassette cover has a fitting portion, and the cassette body has fitting receive portions in the first cassette portion and the second cassette portion. Each of the fitting receive portions in the first cassette portion and the second cassette portion is fittable with the fitting portion. When the cassette body is retracted, the fitting receive portion of the first cassette portion of the cassette body overlaps the fitting receive portion of the second cassette portion of the cassette body in a direction in which the sheet is fed from the sheet feed cassette. When the cassette body is extended, of the fitting receive portions of the first cassette portion and the second cassette portion of the cassette body, one fitting receive portion not fitted with the fitting portion of the cassette cover is at least partially closed.

In another example embodiment of the present invention, an image forming apparatus has a sheet feed cassette to store a sheet supplied to the image forming apparatus. The sheet feed cassette has a cassette body and a cassette cover. The cassette body stores the sheet supplied to the image forming apparatus and has a first cassette portion and a second cassette portion that are coupled adjustably in length. The cassette cover is detachably mounted on the cassette body to cover an upper portion of the cassette body. The cassette cover has a first cover portion and a second cover portion that are coupled adjustably in length. The cassette body has a fitting portion and the cassette cover has fitting receive portions in the first cover portion and the second cover portion. Each of the fitting receive portions in the first cover portion and the second cover portion is fittable with the fitting portion. When the cassette cover is retracted, the fitting receive portion of the first cover portion of the cassette cover overlaps the fitting receive portion of the second cover portion of the cassette cover in a direction in which the sheet is fed from the sheet feed cassette. When the cassette cover is extended, of the fitting receive portions of the first cover portion and the second cover portion of the cassette cover, one fitting receive portion not fitted with the fitting portion of the cassette body is at least partially closed.

In still another example embodiment of the present invention, an image forming apparatus has a sheet feed cassette to store a sheet supplied to the image forming apparatus. The sheet feed cassette has a cassette body, a cassette cover, and a prevention mechanism. The cassette body stores the sheet supplied to the image forming apparatus. The cassette cover is detachably mounted on the cassette body to cover an upper portion of the cassette body. Each of the cassette body and the cassette cover is adjustable between an extended state and a retracted state. The prevention mechanism prevents the cassette cover from being mounted on the cassette body when the cassette body and the cassette cover are in different states of extension/retraction.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
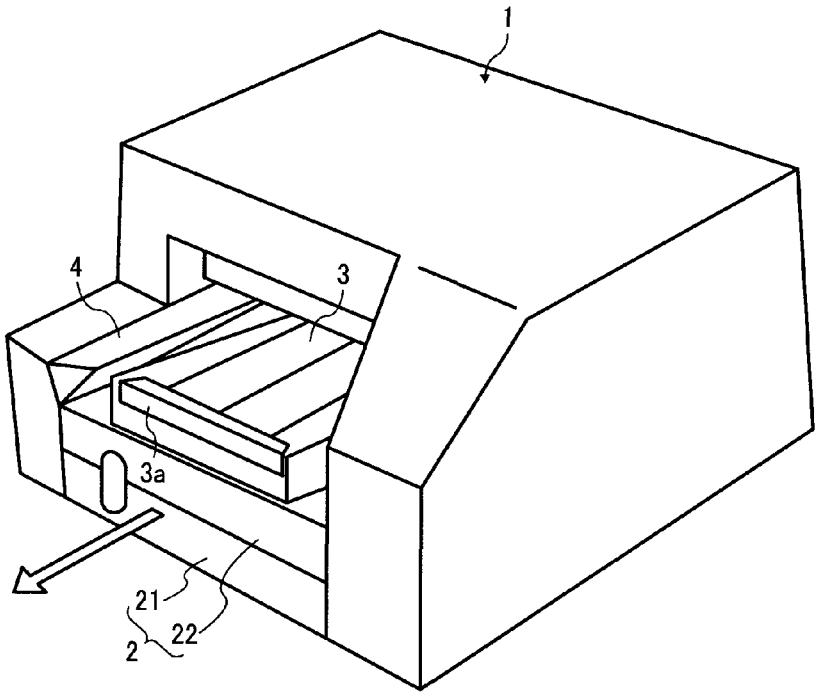
FIG. 1 is a schematic perspective view illustrating a configuration of an image forming apparatus according to an exemplary embodiment of the present invention.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results.

Figure 2:
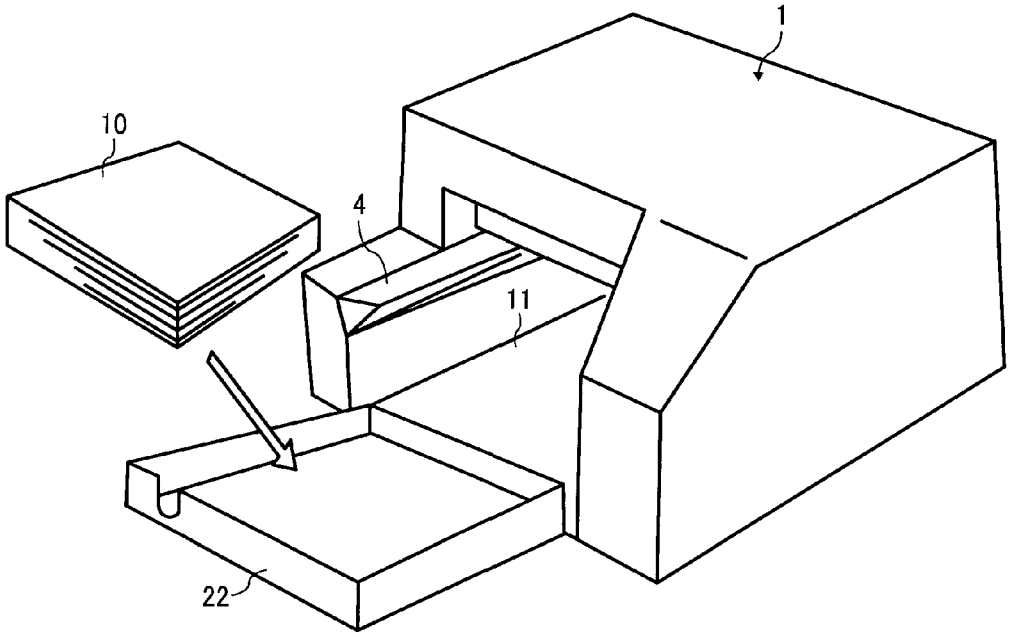
FIG. 2 is a perspective view of the image forming apparatus illustrating an operation in which a sheet feed cassette is refilled with a stack of sheets.
Figure 3:
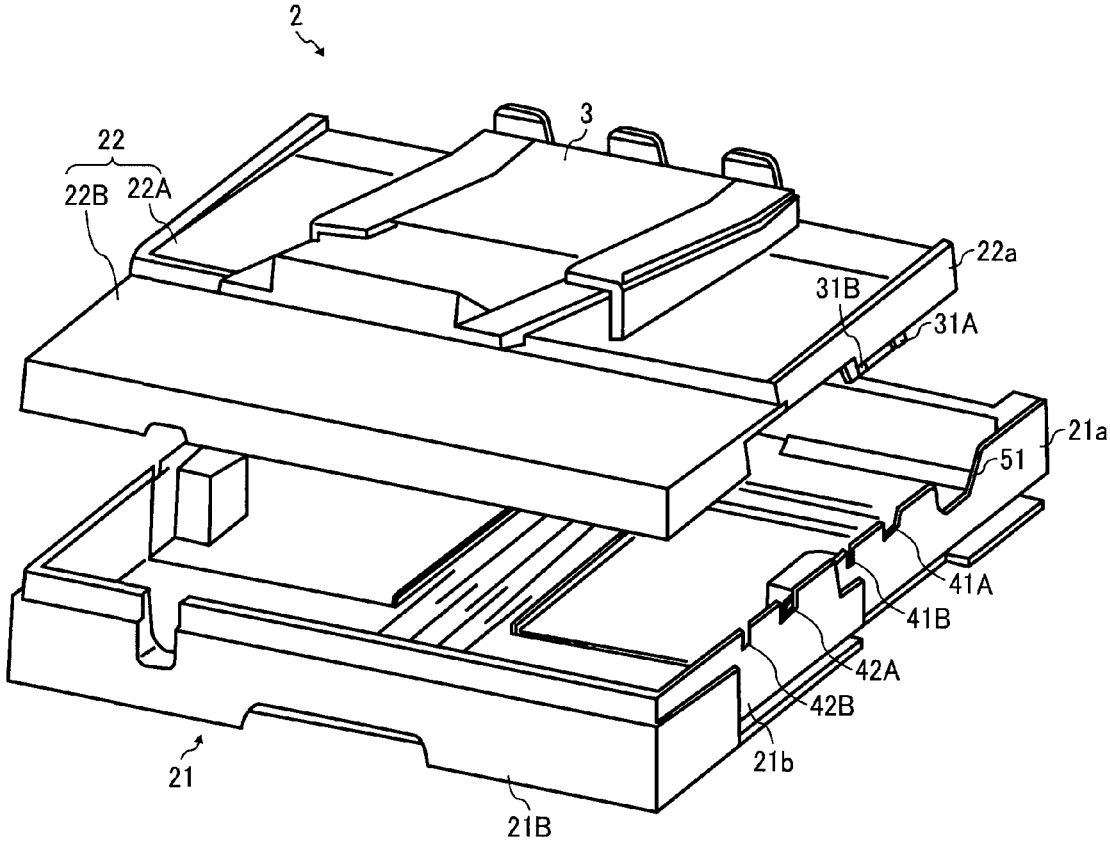
FIG. 3 is an exploded perspective view of the sheet feed cassette of FIG. 2.

Below, exemplary embodiments of the present disclosure are described with reference to attached drawings. With reference to FIGS. 1 and 2, a configuration of an image forming apparatus 1 according to an exemplary embodiment is described. FIG. 1 is a perspective view of the image forming apparatus 1. FIG. 2 is a perspective view illustrating an operation in which a stack of sheets is refilled to the image forming apparatus 1.

The image forming apparatus 1 has a sheet feed cassette 2 to supply a sheet 10 to the image forming apparatus 1. The sheet feed cassette 2 is detachably mountable in a cassette mount opening 11 from a front side of the image forming apparatus 1. In the image forming apparatus 1 is provided an image forming unit to form an image on the sheet 10 using, for example, an inkjet recording method.

The sheet feed cassette 2 has a cassette body 21 and a cassette cover 22. The cassette body 21 stores sheets 10 serving as media supplied to the image forming apparatus 1. The cassette cover 22 is detachably mounted on the cassette body 21 in such a way as to cover an upper portion of the cassette body 21. An upper face of the cassette cover 22 serves as a sheet output tray 3 to which the sheet having the image is output. An extension tray 3*a* is extendibly mounted to the sheet output tray 3.

The sheet feed cassette 2 is detachable from the image forming apparatus 1 with the cassette body 21 and the cassette cover 22 forming one unit. When refilling the sheet feed cassette 2 with a stack of sheets 10, the cassette body 21 and the cassette cover 22 are detached as a single unit from the image forming apparatus 1 toward the front side. Further, the cassette cover 22 is detached from the cassette body 21 and, as illustrated in FIG. 2, the cassette body 21 is refilled with the stack of sheets 10. Then, the cassette cover 22 is mounted on the cassette body 21, and the cassette cover 22 and the cassette body 21 are mounted in the image forming apparatus 1.

The image forming apparatus 1 has a side cover on each side. At each side cover is provided a projection 4 to prevent the cassette cover 22 alone from being detached from the image forming apparatus 1 when the sheet feed cassette 2 is mounted in the image forming apparatus 1.

Next, a detailed description is given of the sheet feed cassette 2 with reference to FIGS. 3 to 8.

As described above, the sheet feed cassette 2 has the cassette body 21 to store the sheets 10 and the cassette cover 22 detachably mountable on the cassette body 21.

Further, the cassette body 21 has a first cassette portion 21A and a second cassette portion 21B serving as an extension tray slidably coupled to the first cassette portion 21A. The first cassette portion 21A and the second cassette portion 21B are coupled to be adjustable for a length in the sheet feed direction of the cassette body 21, thereby allowing the cassette body 21 to store sheets 10 of different sizes. Thus, the cassette body 21 is adjustable between two, extended and retracted, states of different lengths.

The cassette cover 22 has a first cover portion 22A and a second cover portion 22B slidably coupled to the first cover portion 22A so as to be adjustable to two different lengths as a unit. Such configuration allows the cassette body 21 to be covered with the cassette cover 22 in either the retracted state or the extended state of the cassette body 21.

Fitting convex portions 31A and 31B serving as a fitting portion are provided at a side wall 22*a* of the first cover portion 22A of the cassette cover 22. More specifically, the fitting convex portions 31A and 31B are disposed at different positions on an outer surface side of the side wall 22*a* in a direction in which a sheet 10 is fed from the sheet feed cassette 2.

At a side wall 21*a* of the first cassette portion 21A of the cassette body 21 are provided fitting concave portions 41A and 41B serving as fitting receive portions fittable with the fitting convex portions 31A and 31B, respectively, of the side wall 22*a* of the first cover portion 22A of the cassette cover 22. Further, at a side wall 21*b* of the second cassette portion 21B are provided fitting convex portions 42A and 42B serving as fitting receive portions fittable with the fitting convex portions 31A and 31B, respectively, of the side wall 22*a* of the first cover portion 22A of the cassette cover 22.

Figure 6:
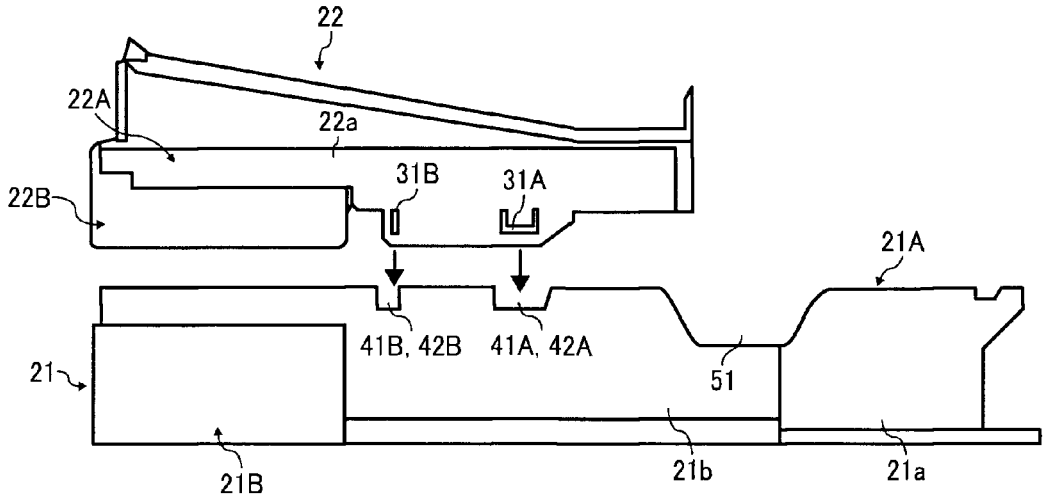
FIG. 6 is a side view of the sheet feed cassette illustrating a relation between a cassette body and a cassette cover when the sheet feed cassette is retracted to set into the image forming apparatus.

When the first cassette portion 21A and the second cassette portion 21B are retracted or shortened as a unit, the fitting concave portions 41A and 41B of the first cassette portion 21A overlap with the fitting concave portions 42A and 42B of the second cassette portion 21B as viewed from a lateral side of the sheet feed cassette 2 as illustrated in FIG. 6.

Figure 7:
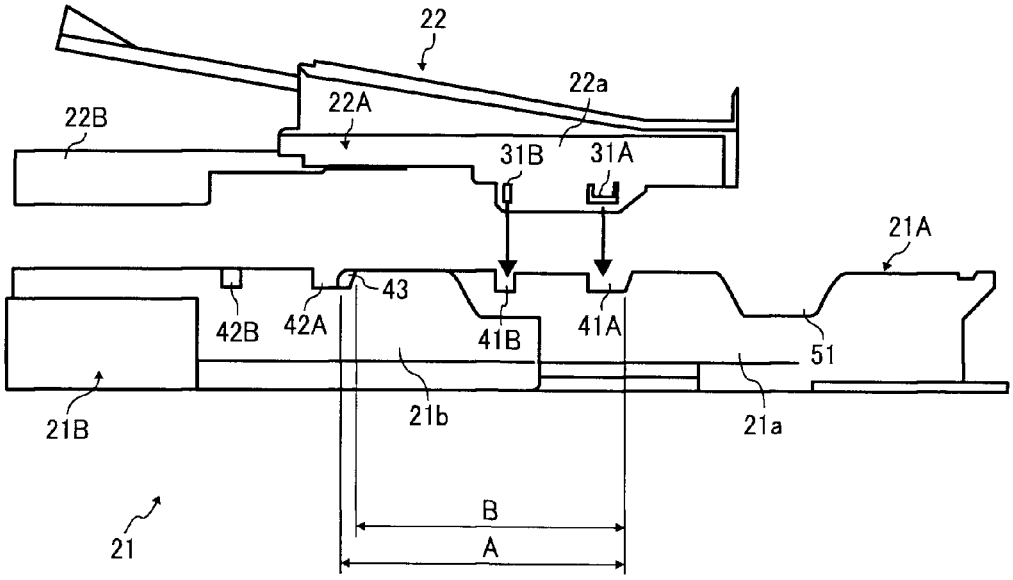
FIG. 7 is a side view of the sheet feed cassette illustrating a relation between the cassette body and the cassette cover when the sheet feed cassette is extended to set into the image forming apparatus.

By contrast, as illustrated in FIG. 7, when the first cassette portion 21A and the second cassette portion 21B are extended as a unit, a rear end portion 43 of the first cassette portion 21A partially closes the fitting concave portion 42A of the second cassette portion 21B. Thus, the distance or length A between a front end of the fitting concave portion 41A of the first cassette portion 21A and the rear end portion 43 is larger or longer than a maximum extended distance or length B between the first cassette portion 21A and the second cassette portion 21B. As a result the rear end portion 43 of the first cassette portion 21A of the cassette body 21 at least partially closes the fitting concave portion 42A of the second cassette portion 21B serving as the fitting receive portion, which is not used when the cassette body 21 is extended. Such configuration can prevent the cassette cover 22 from being mounted on the cassette body 21 when the extension-retraction states of the cassette body 21 and the cassette cover 22 are different.

Figure 4:
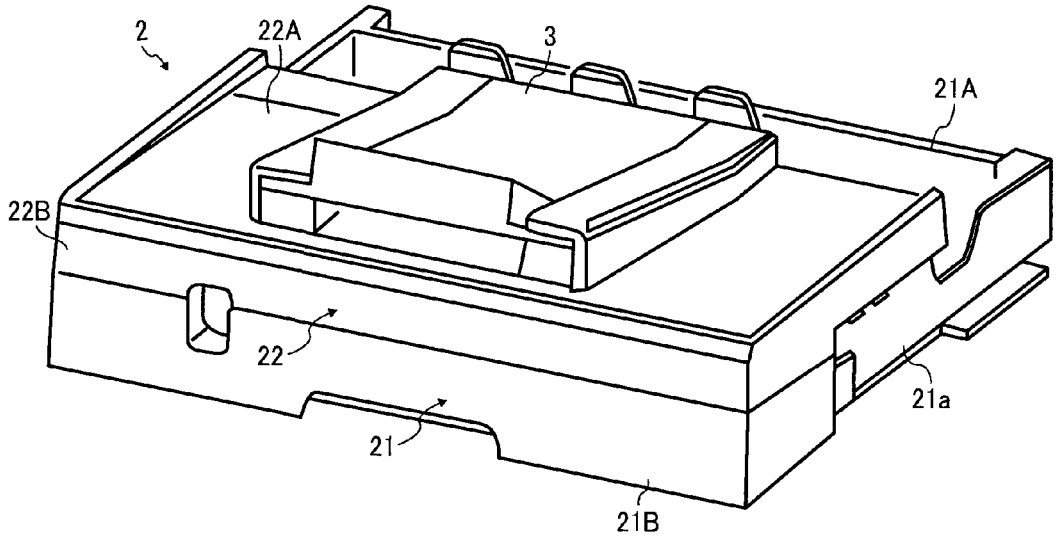
FIG. 4 is a perspective view illustrating a state in which the sheet feed cassette is retracted to store sheets of a relatively small size.

With such configuration, when sheets 10 of a relatively short size are stored in the sheet feed cassette 2, the first cassette portion 21A and the second cassette portion 21B are retracted as a unit so that the fitting concave portions 41A and 41B overlap with the fitting concave portions 42A and 42B, respectively, to form separate single fitting-concave portions as illustrated in FIGS. 4 and 6. When the cassette cover 22 of the retracted state is mounted to the cassette body 21, the fitting convex portion 31A fits with the fitting concave portions 41A and 42A, and the fitting convex portion 31B is fitted with the fitting concave portions 41B and 42B. Thus, the cassette cover 22 can be properly set or mounted on the cassette body 21 and, as a result, the sheet feed cassette 2 can be properly set or mounted in the image forming apparatus 1.

Figure 5:
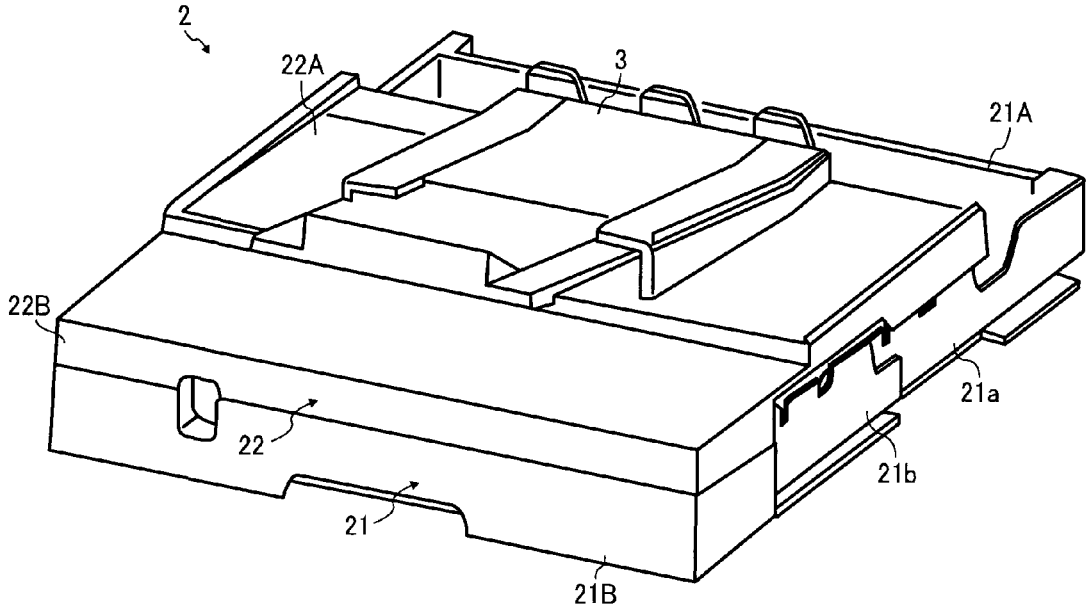
FIG. 5 is a perspective view illustrating a state in which the sheet feed cassette is extended to store sheets of a relatively large size.

When a sheet 10 of a relatively large or long size is stored in the sheet feed cassette 2, as illustrated in FIGS. 5 and 7 the first cassette portion 21A and the second cassette portion 21B are extended as a unit so that the fitting concave portions 41A and 41B are separated from the fitting concave portions 42A and 42B, respectively. When the cassette cover 22 is also extended as a unit, the fitting convex portions 31A and 31B of the first cover portion 22A fit with the fitting concave portions 41A and 41B, respectively, of the first cassette portion 21A. Thus, the cassette cover 22 can be properly set or mounted to the cassette body 21, and as a result, the sheet feed cassette 2 can be properly set or mounted to the image forming apparatus 1.

Figure 8:
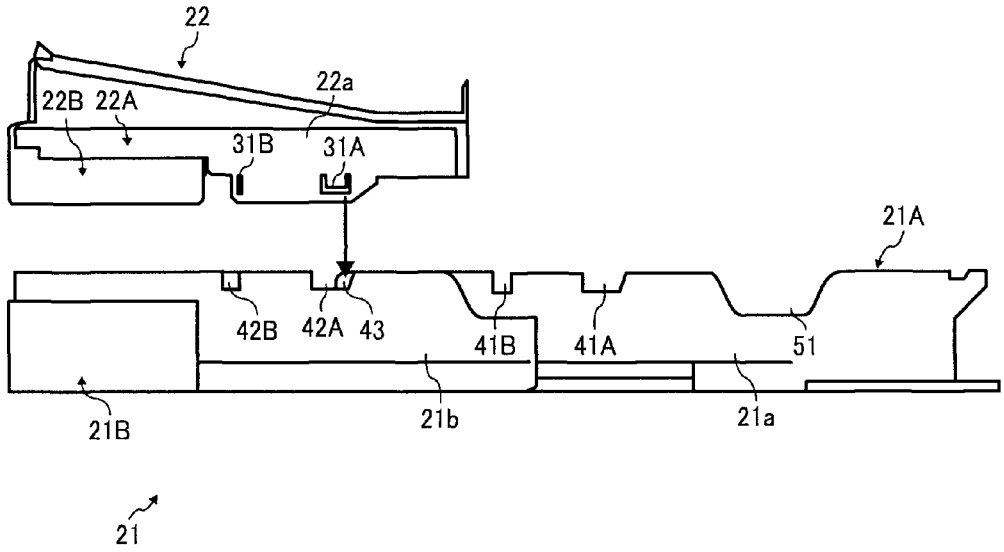
FIG. 8 is a side view of the sheet feed cassette illustrating an improper extension-retraction relation between the cassette body and the cassette cover.

By contrast, as illustrated in FIG. 8, if the cassette cover 22 when in the retracted state is mounted on the cassette body 21 when in the extended state with the rear ends of the cassette body 21 and the cassette cover 22 aligned, the fitting concave portion 42A of the second cassette portion 21B of the cassette body 21 is partially closed by the rear end portion 43 of the first cassette portion 21A. As a result, the fitting convex portion 31A of the cassette cover 22 is prevented from fitting with the fitting concave portion 42A of the second cassette portion 21B of the cassette body 21, thereby causing a portion of the cassette cover 22 to be lifted from the cassette body 21.

In this regard, when the cassette cover 22 of the retracted state is mounted to the cassette body 21 of the extended state, the fitting convex portion 31A of the cassette cover 22 may fit with the fitting concave portion 41A. In such case, however, the second cassette portion 21B is not covered with the cassette cover 22, thereby allowing an operator to easily find a setting error. Therefore, preventing the cassette cover 22 when in the retracted state from being mounted on the cassette body 21 when in the extended state can greatly reduce such improper mounting of the cassette cover 22.

As described above, the cassette body has the first cassette portion and the second cassette portion, which are coupled so as to be adjustable for the length of the cassette body. The cassette cover has the first cover portion and the second cover portion, which are also coupled so as to be adjustable for the length of the cassette cover. The cassette cover has the fitting portion while each of the first cassette portion and the second cassette portion has the fitting receive portion fittable with the fitting portion. The fitting receive portions of the first and second cassette portions are disposed so as to overlap in the sheet feeding direction when the first and second cassette portions are retracted as a unit. When the first and second cassette portions are extended, one fitting receive portion which is not fitted with the fitting portion of the cassette cover, among the fitting receive portions of the first and second cassette portions, is partially closed. Thus, the cassette cover can be prevented from being mounted on the cassette body when the extension-retraction states of the cassette cover and the cassette body are different, thereby preventing sheet feed error due to improper mounting of the cassette cover.

Thus, the sheet feeding cassette has the cassette body to store sheets supplied to the image forming apparatus and the cassette cover to cover a top portion of the cassette body. Each of the cassette body and the cassette cover is adjustable between different lengths. The sheet feed cassette has a prevention mechanism to prevent the cassette cover from being mounted on the cassette body when the cassette body and the cassette cover are in different states of extension/retraction. Thus, the cassette cover is prevented from being mounted on the cassette body when the cover and the body are in different states of extension/retraction, thereby preventing sheet feed error due to improper mounting.

Figure 9:
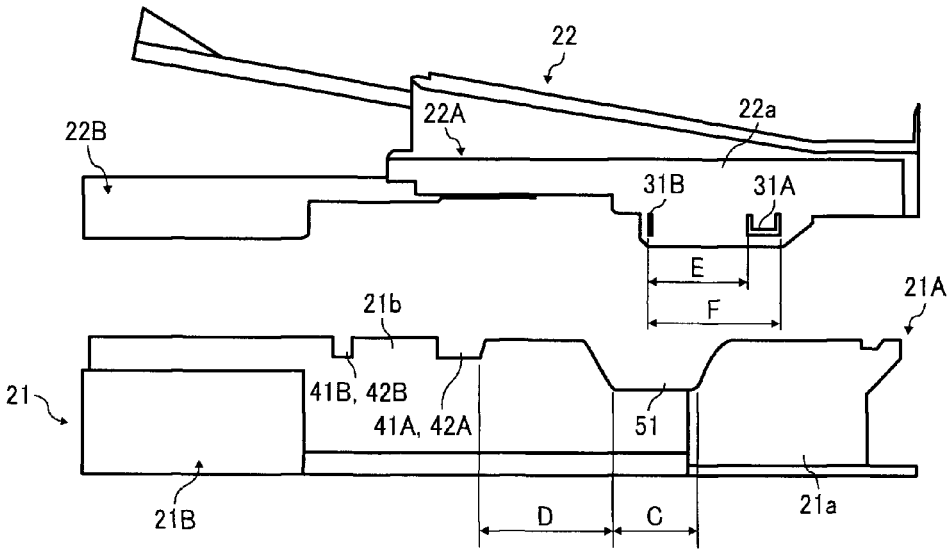
FIG. 9 is a side view of the sheet feed cassette illustrating a relation between a cutout portion for a side fence and a fitting convex portion of the cassette cover.
Figure 10:
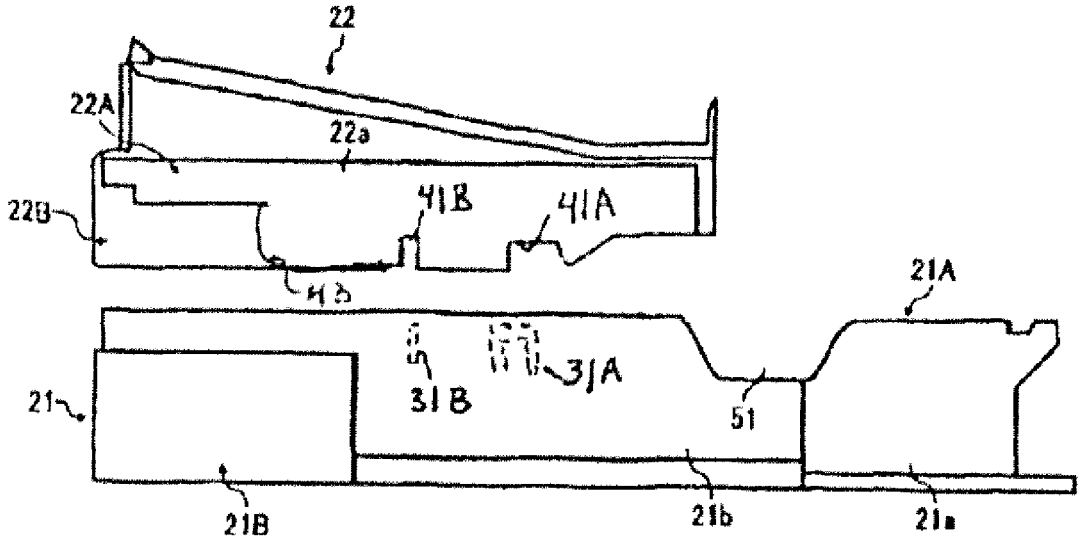
FIGS. 10 and 11 are otherwise similar to FIGS. 6 and 7 but illustrate providing a fitting portion to the cassette body while providing fitting receive portion to the cassette cover.
Figure 11:
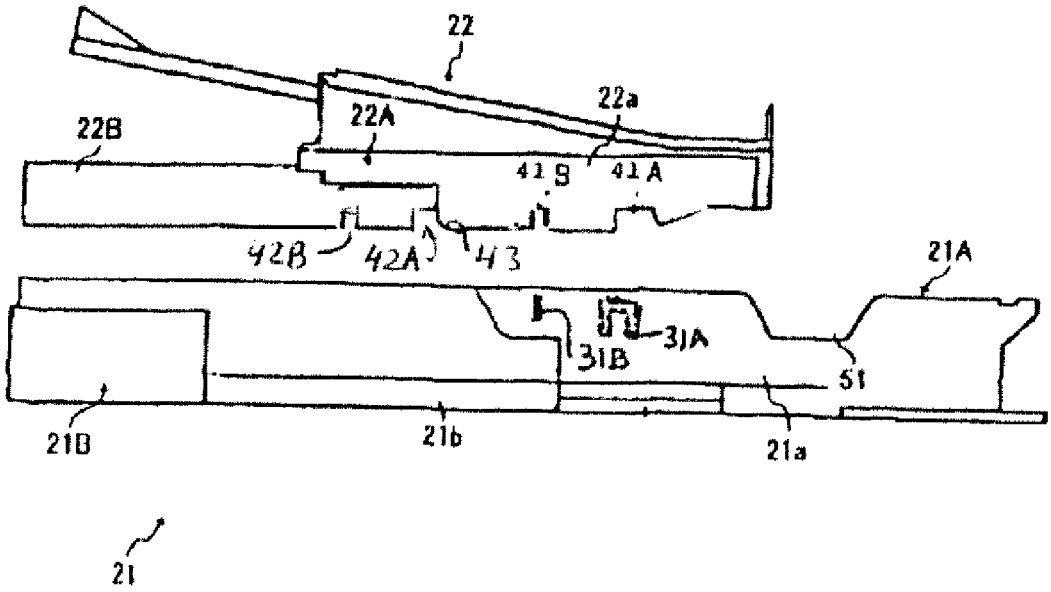

Further, the sheet feed cassette 2 has a so-called "side fence", not illustrated, serving as a width-direction regulator to regulate a side portion of a stack of sheets 10 stored in the cassette body 21. At the side wall 21*a* of the first cassette portion 21A is provided a cutout portion 51 through which the width-direction regulator is operated. As illustrated in FIG. 9, the cutout portion 51 is disposed between the front end of the cassette body 21 (the end of the side on which the cassette body 21 is inserted to the image forming apparatus 1) and the fitting convex portion 41A.

In such case, if a distance E shown in FIG. 9 between the fitting convex portions 31A and 31B of the cassette cover 22 is longer than an interval D between the cutout portion 51 of the first cassette portion 21A and the fitting concave portion 41A, although the distance E is shorter than a distance of the interval D plus a length of the fitting concave portion 41A, the fitting convex portions 31A and 31B might align with the cutout portion 51 and the fitting concave portion 41A. Alternatively, if a distance F between outer ends of the fitting convex portions 31A and 31B of the cassette cover 22 is shorter than a length C of the cutout portion 51 of the first cassette portion 21A, the fitting convex portions 31A and 31B might align with the cutout portion 51. In such case, the cassette cover 22 might be improperly set to the cassette body 21.

Hence, for the sheet feed cassette 2, the relative positions of the cutout portion 51 and the fitting convex portions 31A and 31B are set so as to satisfy relations of $E<D$ and $F>C$. In other words, for the sheet feed cassette 2, the distance E between the fitting convex portions 31A and 31B of the cassette cover 22 is shorter than the interval D between the cutout portion 51 and the fitting concave portion 41A ($E<D$), while the interval F between the outer ends of the fitting convex portions 31A and 31B of the cassette cover 22 is longer than the length C of the cutout portion 51 of the first cassette portion 21A (F>C).

Such configuration can prevent the cassette cover 22 from being mounted on the cassette body 21 in an improper state.

Although in the above-described exemplary embodiment the fitting portion is provided to the cassette cover while the fitting receive portion is provided to the cassette body, it should be noted that, conversely, a fitting portion may be provided to the cassette body while a fitting receive portion may be provided to the cassette cover. In such case, the fitting portion is provided to the cassette body while the fitting receive portion fitted with the fitting portion may be provided to each of the first and second cover portions. The respective fitting receive portions of the first and second cover portions of the cassette cover are disposed so as to overlap in the sheet feeding direction when the first and second cover portions are retracted as a unit. Further, of the fitting receive portions of the first and second cover portions, one fitting receive portion not fitted with the fitting portion of the cassette body is at least partially closed when the first and second cover portions are extended as a unit. Such configuration can provide effects similar to those of the above-described exemplary embodiment.

Elements and/or features of different example embodiments may be combined with each other and/or substituted for each other within the scope of this disclosure and appended claim.

Examples and embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. An image forming apparatus, comprising a sheet feed cassette to store a sheet supplied to the image forming apparatus, the sheet feed cassette having a cassette body and a cassette cover, the cassette body configured to store the sheet supplied to the image forming apparatus, the cassette body having a first cassette portion and a second cassette portion, the first cassette portion and the second cassette portion coupled adjustably in length, the cassette cover detachably mountable on the cassette body to cover an upper portion of the cassette body, the cassette cover having a first cover portion and a second cover portion, the first cover portion and the second cover portion coupled adjustably in length, the cassette cover having a fitting portion, the cassette body having fitting receive portions in the first cassette portion and the second cassette portion, each of the fitting receive portions in the first cassette portion and the second cassette portion fittable with the fitting portion, wherein, when the cassette body is retracted, the fitting receive portion of the first cassette portion of the cassette body overlaps the fitting receive portion of the second cassette portion of the cassette body in a direction in which the sheet is fed from the sheet feed cassette, and wherein, when the cassette body is extended, one fitting receive portion not fitted with the fitting portion of the cassette cover among the fitting receive portions of the first cassette portion and the second cassette portion of the cassette body is at least partially closed.

2. The image forming apparatus according to claim 1, wherein the cassette body has a regulator to regulate the sheet with respect to a width direction of the sheet and a cutout portion through which the regulator is operated, and wherein the cutout portion is disposed on a face of the cassette body identical to a face on which the fitting receive portions are provided and at a position different in a longitudinal direction of the cassette body from any of positions at which the fitting receive portions are provided.

3. An image forming apparatus, comprising a sheet feed cassette to store a sheet supplied to the image forming apparatus, the sheet feed cassette having a cassette body and a cassette cover, the cassette body configured to store the sheet supplied to the image forming apparatus, the cassette body having a first cassette portion and a second cassette portion, the first cassette portion and the second cassette portion coupled adjustably in length, the cassette cover detachably mountable on to the cassette body to cover an upper portion of the cassette body, the cassette cover having a first cover portion and a second cover portion, the first cover portion and the second cover portion coupled adjustably in length, the cassette body having a fitting portion, the cassette cover having fitting receive portions in the first cover portion and the second cover portion, each of the fitting receive portions in the first cover portion and the second cover portion finable with the fitting portion, wherein, when the cassette cover is retracted, the fitting receive portion of the first cover portion of the cassette cover overlaps the fitting receive portion of the second cover portion of the cassette cover in a direction in which the sheet is fed from the sheet feed cassette, and wherein, when the cassette cover is extended, one fitting receive portion not fitted with the fitting portion of the cassette body among the fitting receive portions of the first cover portion and the second cover portion of the cassette cover is at least partially closed.

* * * * *